US009309768B2

(12) United States Patent
Reinhold et al.

(10) Patent No.: US 9,309,768 B2
(45) Date of Patent: Apr. 12, 2016

(54) TURBINE

(71) Applicant: MAN Diesel & Turbo SE, Augsburg (DE)

(72) Inventors: Björn Reinhold, Hamburg (DE); Thomas Schaake, Seevetal (DE)

(73) Assignee: MAN Diesel & Turbo SE, Augsburg (DE)

( * ) Notice: Subject to any disclaimer, the term of this patent is extended or adjusted under 35 U.S.C. 154(b) by 599 days.

(21) Appl. No.: 13/693,266

(22) Filed: Dec. 4, 2012

(65) Prior Publication Data

US 2013/0189078 A1 Jul. 25, 2013

(30) Foreign Application Priority Data

Dec. 6, 2011 (DE) ..... 10 2011 087 824

(51) Int. Cl.
*F01D 3/00* (2006.01)
*F01D 3/04* (2006.01)

(52) U.S. Cl.
CPC ..... *F01D 3/04* (2013.01)

(58) Field of Classification Search
CPC ..... F01D 3/04; F01D 3/00
USPC ..... 415/104, 105, 106, 107
See application file for complete search history.

(56) References Cited

U.S. PATENT DOCUMENTS

| | | | |
|---|---|---|---|
| 1,895,003 | A | 1/1933 | Meyer |
| 3,614,255 | A | 10/1971 | Rooney |
| 4,472,107 | A | 9/1984 | Chang et al. |
| 4,578,018 | A | 3/1986 | Pope |
| 6,345,952 | B1 | 2/2002 | Oeynhausen |

FOREIGN PATENT DOCUMENTS

| | | |
|---|---|---|
| CH | 88025 | 2/1921 |
| CN | 102016231 | 4/2011 |
| DE | 191 437 | 11/1907 |
| DE | 23 44 243 | 3/1974 |
| DE | 19863616797 | 11/1987 |
| DE | 197 01 020 | 7/1998 |
| DE | 10 2006 049 516 | 1/2008 |
| DE | 10 2008 022 966 | 12/2009 |
| WO | WO 2009/135802 | 11/2009 |

*Primary Examiner* — Edward Look
*Assistant Examiner* — Jason Mikus
(74) *Attorney, Agent, or Firm* — Cozen O'Connor

(57) ABSTRACT

A turbine includes a stator (10) and a rotor (20); a plurality of turbine stages (30) through which a flow path of an operating fluid extends; an axial thrust balancing piston (40) arranged at the rotor and a first piston chamber (41) connected to one of the turbine stages (30.1) so that the operating fluid can be conveyed into the first piston chamber with a first fluid pressure, and a second piston chamber (42) has a counterpressure so that an axial thrust opposed to a flow direction of the operating fluid can be exerted on the rotor; and a pressure control device (60) connected to the second piston chamber. The pressure control device constructed to vary the counterpressure by controlled removal of fluid from the second piston chamber so that the axial thrust of the axial thrust balancing piston can be varied.

14 Claims, 2 Drawing Sheets

TURBINE

BACKGROUND OF THE INVENTION

1. Field of the Invention

The invention is directed to a turbine including a thrust balancing piston.

2. Description of the Related Art

A turbine of the type mentioned above is known, for example, from U.S. Pat. No. 3,614,255 A. In this turbine having a high-pressure region and an intermediate-pressure region with opposed flows of operating fluid, axial thrusts generated by the high-pressure region and intermediate-pressure region are balanced during normal operation of the turbine in that the axial thrust of the intermediate-pressure region and a substantially constant axial thrust of an axial thrust balancing piston counteract the axial thrust of the high-pressure region. With the blocking of the operating fluid supply to the intermediate-pressure region that is made possible by a valve during a temporary operation of the turbine, a very small counterpressure is brought about compulsorily in a piston chamber of the axial thrust balancing piston, which piston chamber is associated with the intermediate-pressure region, so that there is an increase in the axial thrust on the rotor which is exerted by the axial thrust balancing piston opposite to the flow direction of the operating fluid through the high-pressure region.

It is an object of the present invention to provide a turbine in which the axial thrust of an axial thrust balancing piston can be varied during normal operation of the turbine.

SUMMARY OF THE INVENTION

According to the invention, a turbine has: a stator and a rotor which is rotatably bearing-supported in the stator; a plurality of turbine stages which are formed by the rotor and the stator and arranged successively along a longitudinal direction of the turbine and through which a flow path of an operating fluid extends for driving the rotor in rotation; an axial thrust balancing piston which is arranged at the rotor and which has on a first axial piston side a first piston chamber which is connected to one of the turbine stages via a first fluid line so that the operating fluid can be conveyed from one turbine stage into the first piston chamber with a first fluid pressure and, on a second axial piston side remote of the first piston side, a second piston chamber which is adapted to have a counterpressure that is lower than the first fluid pressure so that an axial thrust opposed to a flow direction of the operating fluid through the turbine stages can be exerted on the rotor by the axial thrust balancing piston; and a pressure control device which is connected to the second piston chamber of the axial thrust balancing piston and which is adapted to vary the counterpressure. The turbine according to the invention is characterized in that the pressure control device is adapted to vary the counterpressure by removing fluid from the second piston chamber in a controlled manner.

By removing fluid from the second piston chamber in a controlled manner during normal operation of the turbine, the counterpressure can be varied and, therefore, a pressure difference between the first fluid pressure and the counterpressure can be varied. Accordingly, the axial thrust of the axial thrust balancing piston can be varied in turn during normal operation of the turbine. According to the invention, the counterpressure can be reduced or increased so that the pressure difference and, therefore, the axial thrust of the axial thrust balancing piston is increased or reduced.

The turbine is preferably constructed as a reaction turbine type with a high, powerful axial thrust in the flow direction of the operating fluid through the turbine stages. Further, the operating fluid is preferably steam so that the turbine is configured as a steam turbine. A non-limiting example of a reaction turbine or steam turbine is described in U.S. Pat. No. 6,345,952 the entire content of which is incorporated herein by reference. Further, the fluid which is sucked out of the second piston chamber is formed by operating fluid.

According to an embodiment of the invention, the pressure control device is adapted to vary the counterpressure through controlled suction of fluid out of the second piston chamber.

By actively removing fluid the second piston chamber by suction it is possible to greatly reduce the counterpressure far beyond the degree that would otherwise be possible so that the pressure difference and, therefore, the axial thrust of the axial thrust balancing piston are greatly increased. Therefore, for example, a thrust bearing which axially supports the rotor can have smaller dimensions than usual so that costs can be economized.

The pressure control device is preferably constructed as a fluid pump and has a suction side which is connected to the second piston chamber by a second fluid line. Further, the pressure control device preferably has a delivery side which is connected by a third fluid line to the flow path of the operating fluid at a further turbine stage of the turbine stages which is situated downstream of the turbine stage in the flow path, this further turbine stage being adapted to have a second fluid pressure of operating fluid which is lower than the first fluid pressure.

In this way, when the fluid that is sucked out is operating fluid as is preferred, this sucked out fluid is fed back to the turbine process so that the efficiency of the turbine is increased.

According to yet another embodiment of the invention, the pressure control device is constructed as a steam jet ejector and has a motive side which is connected to the flow path of the operating fluid by a fourth fluid line so that the operating fluid can be supplied to the motive side for driving the steam jet ejector.

In this way, no separate medium need be provided for driving the fluid pump so that additional costs are saved and the complexity of the turbine is reduced. In this context, the fourth fluid line is preferably connected to the first fluid line so that the operating fluid can be supplied to the motive side from the first fluid line. Non-limiting examples of steam jet ejectors and use thereof in turbines are described, for example, in CH 88025 A and DE 36 16 797 A1 the entire content thereof is incorporated herein by reference.

According to another embodiment of the invention, a servo valve is arranged in the fourth fluid line so that an amount of operating fluid that can be supplied to the motive side of the pressure control device can be varied.

By varying the amount of operating fluid supplied to the motive side of the pressure control device in a controlled manner during normal operation of the turbine, the suction power of the steam jet ejector is varied in a controlled manner. Accordingly, the pressure difference between first fluid pressure and counterpressure and, therefore, the axial thrust of the axial thrust balancing piston are in turn varied in a controlled manner in a simple and robust fashion.

According to a further embodiment of the invention, the pressure control device is so configured through selection of suitable motive steam parameters and diameters that an amount of fluid removed from the second piston chamber is approximately twice the amount of operating fluid supplied to the motive side of the pressure control device. In other words, an amount of motive steam is, conversely, preferably half of the amount of suction steam that is realized. As a result of this configuration of the steam jet ejector, the counterpressure on the second axial piston side of the axial thrust balancing piston can be halved by means of the amount of operating fluid or the amount of motive steam supplied to the motive side of the pressure control device.

According to yet another embodiment of the invention, the turbine has a control device having at least one signal input which is connected to a sensor device sensing at least one state parameter of the turbine and a signal output which is connected to the servo valve. The control device is adapted to control via the signal output a degree of opening of the servo valve depending on the at least one state parameter of the turbine.

In this way, the axial thrust of the axial thrust balancing piston can be varied and, in particular, adjusted depending on one or more state parameters (e.g., steam throughput, speed, temperature, bearing condition, etc.) of the turbine.

The sensor device preferably has a temperature sensor for sensing the temperature of the thrust bearing of the rotor, and the control device is adapted to regulate the degree of opening of the servo valve depending on the temperature of the thrust bearing of the rotor.

Finally, according to an embodiment of the invention, it is possible to increase the axial thrust balance in reaction turbines further than would be possible, e.g., if the balancing piston were connected to a very low pressure level. Here, a steam jet ejector reduces the pressure behind a balancing piston to below the level of the connected pipeline.

The invention also expressly extends to embodiments which are not given by combinations of features from explicit references to the claims so that the disclosed features of the invention can be combined with one another in any way insofar as technically meaningful.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will now be described in more detail in the following with reference to a preferred embodiment and the accompanying drawings, in which.

DETAILED DESCRIPTION OF THE PRESENTLY PREFERRED EMBODIMENTS

Figure 1:
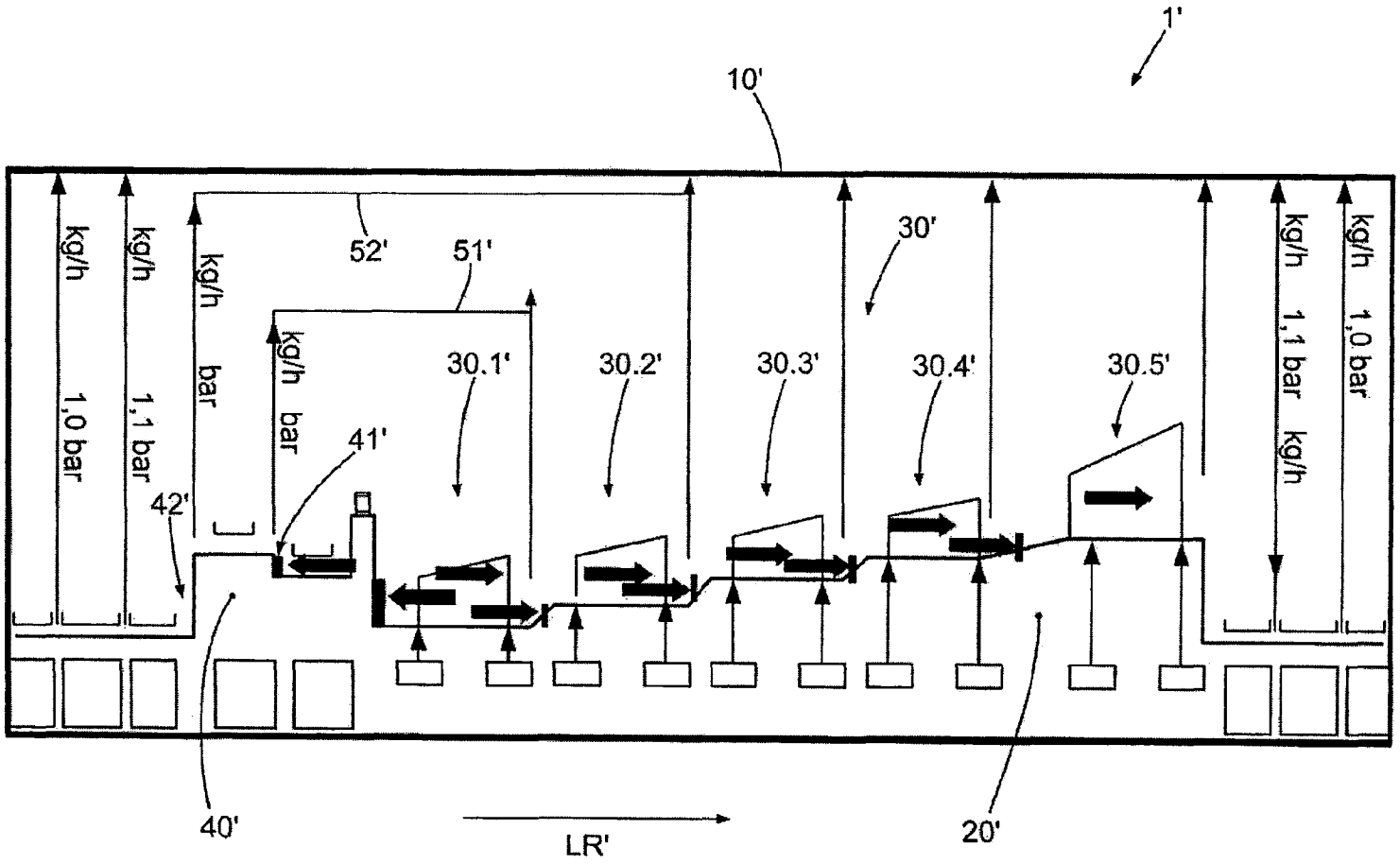
FIG. 1 shows an embodiment of a turbine with an axial thrust balancing piston.

First, the effects of axial thrust in a turbine 1' having an axial thrust balancing piston 40' will be explained referring to FIG. 1.

The turbine 1' has a stator 10' (only shown schematically) and a rotor 20' which is rotatably bearing-supported in the stator 10', a plurality of turbine stages 30.1' to 30.5' (designated in the following in their entirety by 30'), and the axial thrust balancing piston 40'.

The turbine stages 30' formed by the rotor 20' and stator 10' are successively arranged along a longitudinal direction LR' of the turbine 1', and a flow path of an operating fluid for driving the rotor 20' in rotation extends through the turbine stages 30'. According to this embodiment, the operating fluid is formed by steam so that the turbine 1' is configured as a steam turbine. In FIG. 1, a flow direction of the operating fluid through the turbine stages 30' corresponds to the longitudinal direction LR'.

According to this embodiment, moreover, the turbine 1' is constructed as a reaction turbine type with high, powerful axial thrust in the flow direction of the operating fluid through the turbine stages 30'. This axial thrust which is brought about by the interaction of the operating fluid with the turbine stages 30' is depicted in FIG. 1 by rightward arrows in bold.

The axial thrust balancing piston 40' is arranged at the rotor 20' and has a first piston chamber 41' on a first axial piston side, this first piston chamber 41' being fluidically connected to the first turbine stage 30.1' of turbine stages 30' by a first fluid line 51' so that the operating fluid is conveyed out of the first turbine stage 30.1' into the first piston chamber 41' during operation of the turbine 1' with a first fluid pressure.

The axial thrust balancing piston 40' further has a second piston chamber 42' on a second axial piston side remote of the first piston side, this second piston chamber 42' being fluidically connected to the second turbine stage 30.2' of turbine stages 30' by a second fluid line 52', which second turbine stage 30.2' is situated downstream of the first turbine stage 30.1' in the flow path. During operation of the turbine 1', the second turbine stage 30.2' has a second fluid pressure of operating fluid which is lower than the first fluid pressure. Accordingly, during operation of the turbine 1' the second piston chamber 42' has a counterpressure (second fluid pressure) which is lower than the first fluid pressure.

Because of these pressure ratios, during operation of the turbine 1' the axial thrust balancing piston 40' exerts an axial thrust (leftward arrows in bold in FIG. 1) on the rotor 20' opposed to the flow direction (longitudinal direction LR) of the operating fluid through the turbine stages 30'.

As a result of this axial thrust (leftward arrows in bold in FIG. 1) opposite the flow direction (longitudinal direction LR) of the operating fluid through the turbine stages 30', the axial thrust (rightward arrows in bold in FIG. 1) brought about through the interaction of the operating fluid with the turbine stages 30' is partially compensated. The residual axial thrust in longitudinal direction LR must be absorbed by a thrust bearing, not shown, for rotor 20'. In this regard, it will be understood that the thrust bearing for the rotor 20' must be designed to be larger and more stable the greater the residual axial thrust in longitudinal direction LR.

It was recognized by the inventors that the total axial thrust and residual axial thrust to be absorbed by the thrust bearing can be reduced by reducing the pressure level in the second piston chamber 42'. According to the embodiment in FIG. 1, this could be achieved by connecting the second fluid line 52' to a lower pressure level in the turbine 1'.

However, it was also recognized by the inventors that it would be advantageous if the axial thrust of the axial thrust balancing piston could be varied during normal operation of the turbine so that the axial thrust could be adapted, e.g., to current state parameters (such as steam throughput, speed, temperature, bearing condition, etc.).

A solution of this kind will now be described referring to FIG. 2 which shows a turbine 1 according to an embodiment of the invention. Identical or similar reference numerals (without apostrophe) designate identical or similar components in the following description of FIG. 2.

The turbine 1 shown in FIG. 2 has a stator 10 (only shown schematically) and a rotor 20 which is rotatably bearing-supported in the stator 10, a plurality of turbine stages 30.1 to 30.5 (designated in the following in their entirety by 30), an axial thrust balancing piston 40, and a pressure control device 60.

The turbine stages 30 formed by the rotor 20 and stator 10 are successively arranged along a longitudinal direction LR of the turbine 1, and a flow path of an operating fluid for driving the rotor 20 in rotation extends through the turbine stages 30. According to this embodiment of the invention, the operating fluid is formed by steam so that the turbine 1 is configured as a steam turbine. In FIG. 2, a flow direction of the operating fluid through the turbine stages 30 corresponds to the longitudinal direction LR.

Figure 2:
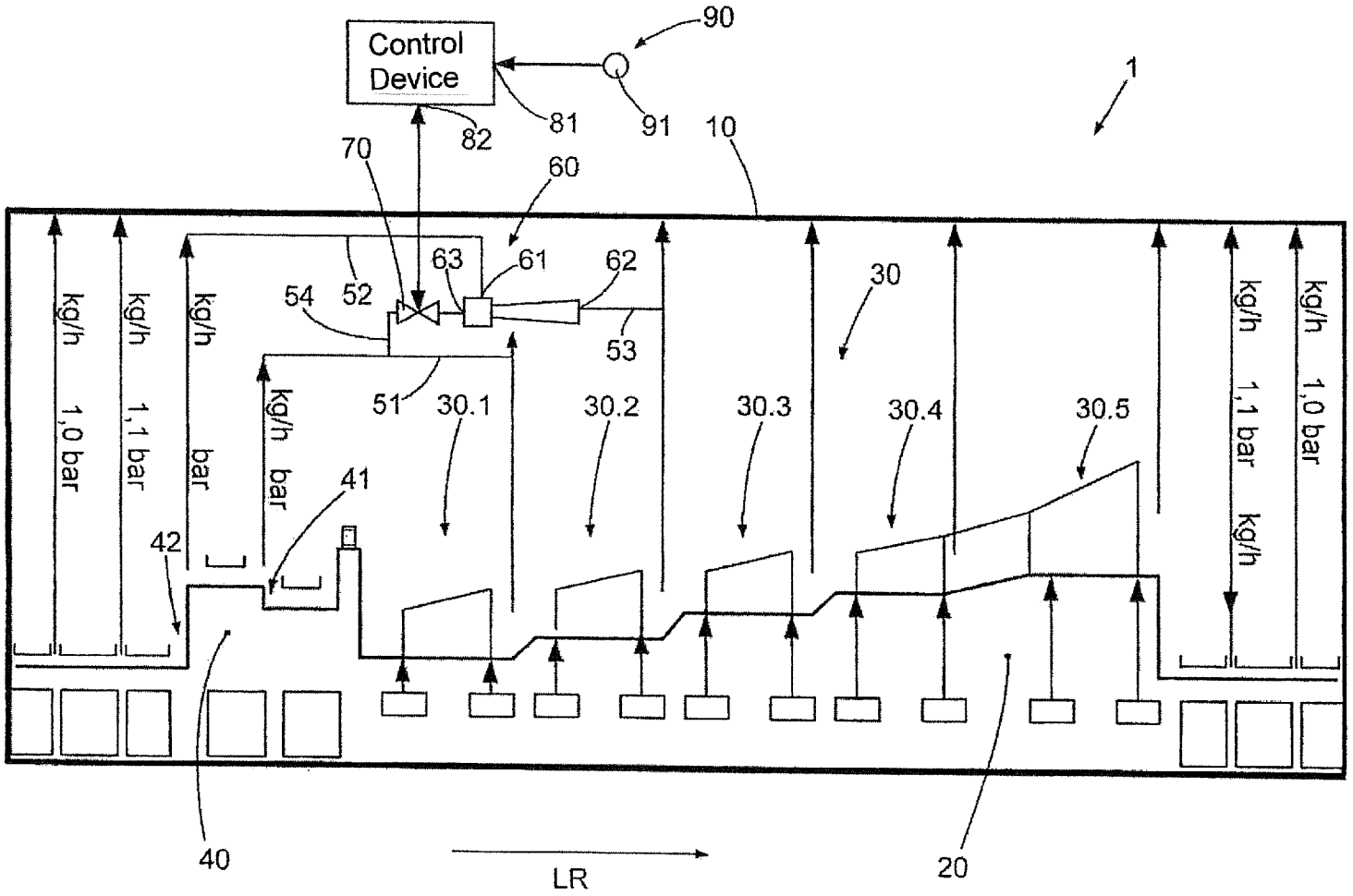
FIG. 2 shows a turbine according to an embodiment of the invention.

Further, according to this embodiment of the invention, the turbine 1 is constructed as a reaction turbine type with high, powerful axial thrust in the flow direction of the operating fluid through the turbine stages 30 (toward the right-hand side in FIG. 2). This axial thrust which is brought about by the interaction of the operating fluid with the turbine stages 30 corresponds to the axial thrust depicted in FIG. 1 by rightward arrows in bold.

The axial thrust balancing piston 40 is arranged at the rotor 20 and has a first piston chamber 41 on a first axial piston side, this first piston chamber 41 being fluidically connected to the first turbine stage 30.1 of turbine stages 30 by a first fluid line 51 so that the operating fluid is conveyed out of the first turbine stage 30.1 into the first piston chamber 41 during operation of the turbine 1 with a first fluid pressure.

The axial thrust balancing piston 40 further has a second piston chamber 42 on a second axial piston side remote of the first piston side, this second piston chamber 42 having a counterpressure which is lower than the first fluid pressure during operation of the turbine 1.

The pressure control device 60 is constructed as a fluid pump in the form of a steam jet ejector and has a suction side 61 (with a suction steam connection) which is fluidically connected to the second piston chamber 42 by a second fluid line 52 so that the counterpressure is formed in the second piston chamber 42 during operation of the turbine 1 by controlled removal, particularly as in this case by suction, of operating fluid from the second piston chamber 42 and can be varied as required.

The pressure control device 60 further has a delivery side 62 (with an output steam connection) which is fluidically connected by a third fluid line 53 to the flow path of the operating fluid at the second turbine stage 30.2 of turbine stages 30, which second turbine stage 30.2 is situated downstream of the first turbine stage 30.1 in the flow path. During operation of the turbine 1, the second turbine stage 30.2 has a second fluid pressure of operating fluid which is lower than the first fluid pressure.

Further, the pressure control device 60 has a motive side 63 (with a motive steam connection) which is fluidically connected to the flow path of the operating fluid by a fourth fluid line 54 so that the operating fluid can be supplied to the motive side 63 for driving the pressure control device 60. More precisely, the fourth fluid line 54 is fluidically connected to the first fluid line 51 so that the operating fluid can be supplied to the motive side 63 from the first fluid line 51.

Because of the pressure ratios described above (counterpressure<first fluid pressure), during operation of the turbine 1 the axial thrust balancing piston 40 exerts an axial thrust (corresponding to the leftward arrows in bold in FIG. 1) leftwards on the rotor 20, which axial thrust is opposed to the flow direction (longitudinal direction LR) of the operating fluid through the turbine stages 30.

As a result of this axial thrust leftwards opposite to the flow direction (longitudinal direction LR) of the operating fluid through the turbine stages 30, the rightward axial thrust brought about through the interaction of the operating fluid with the turbine stages 30 is compensated to a certain extent. The residual axial thrust in longitudinal direction LR (toward the right) must be absorbed by a thrust bearing, not shown, for rotor 20.

In order to control, in particular to adjust, the leftward axial thrust provided by the axial thrust balancing piston 40, a servo valve 70 is arranged in the fourth fluid line 54 so that an amount of operating fluid that can be supplied to the motive side 63 of the pressure control device 60 can be varied.

By varying the amount of operating fluid supplied to the motive side 63 of the pressure control device 60 in a controlled manner during normal operation of the turbine 1, the suction power of the pressure control device 60 (steam jet ejector) is varied in a controlled manner. Accordingly, the pressure difference between first fluid pressure and counterpressure and, therefore, the leftward axial thrust of the axial thrust balancing piston 40 are in turn varied in a controlled manner in a simple and robust fashion.

The pressure control device 60 is preferably so configured that an amount of operating fluid removed from the second piston chamber 42 is approximately twice the amount of operating fluid supplied to the motive side 63 of the pressure control device 60. In other words, an amount of motive steam is, conversely, preferably half of the amount of suction steam that is realized. As a result of this configuration of the pressure control device 60, the counterpressure on the second axial piston side of the axial thrust balancing piston 40 can be halved by means of the amount of operating fluid or the amount of motive steam supplied to the motive side 63 of the pressure control device 60.

Further, the turbine 1 has a control device 80 having at least one signal input 81 which is signal-connected to a sensor device 90 sensing at least one state parameter of the turbine 1 and a bidirectional signal output 82 which is connected to the servo valve 70 and can sense a position of the servo valve 70 by means of the bidirectional connection.

The control device 80 is adapted to control via the signal output 82 a degree of opening of the servo valve 70 depending on the at least one state parameter of the turbine 1.

In this way, the axial thrust of the axial thrust balancing piston 40 can be varied and, in particular, adjusted depending on one or more state parameters (e.g., steam throughput, speed, temperature, bearing condition, etc.) of the turbine 1.

According to the embodiment of the invention shown in FIG. 2, the sensor device 90 has a temperature sensor 91 for sensing the temperature of the thrust bearing of the rotor 20, and the control device 80 is adapted to control the degree of opening of the servo valve 70 depending on the temperature of the thrust bearing of the rotor 20.

Finally, it is possible according to the invention to increase the axial thrust balance in turbines, such as reaction turbines in particular, further than would be possible, e.g., if the axial thrust balancing piston 40 were connected to a very low pressure level. For this purpose, a pressure control device, preferably a steam jet ejector, reduces the pressure behind the axial thrust balancing piston 40 to below the level of the connected fluid line by means of controlled removal of fluid.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A turbine comprising:

a stator (10);

a rotor (20) rotatably bearing-supported in said stator (10);

a plurality of turbine stages (30) formed by said rotor (20) and said stator (10) and arranged successively along a longitudinal direction (LR) of said turbine and through which a flow path of an operating fluid extends for driving said rotor (20) in rotation;

an axial thrust balancing piston (40) arranged at said rotor (20), said axial thrust balancing piston (40) comprising on a first axial piston side a first piston chamber (41) connected to one of said turbine stages (30.1) via a first fluid line (51) so that the operating fluid can be conveyed from one turbine stage (30.1) into said first piston chamber (41) with a first fluid pressure and, on a second axial piston side remote of the first piston side, a second piston chamber (42) having a counterpressure that is lower than the first fluid pressure so that an axial thrust opposed to a flow direction of the operating fluid through said turbine stages (30) can be exerted on said rotor (20) by said axial thrust balancing piston (40); and a pressure control device (60) connected to said second piston chamber (42) of said axial thrust balancing piston (40) for varying the counterpressure by controlled removal of fluid from said second piston chamber (42).

2. The turbine according to claim 1, wherein said pressure control device (60) is constructed to vary the counterpressure by controlled suction of fluid from said second piston chamber (42).

3. The turbine according to claim 1, wherein said pressure control device (60) is constructed as a fluid pump comprising a suction side (61) connected to said second piston chamber (42) by a second fluid line (52).

4. The turbine according to claim 3, wherein said pressure control device (60) comprises a delivery side (62) connected by a third fluid line (53) to the flow path of the operating fluid at a further one of said turbine stage (30.2) of said turbine stages (30) situated downstream of said one of said turbine stage (30.1) in the flow path; and wherein said further turbine stage (30.2) has a second fluid pressure of operating fluid which is lower than the first fluid pressure.

5. The turbine according to claim 3, wherein said pressure control device (60) is constructed as a steam jet ejector having a motive side (63) connected to the flow path of the operating fluid by a fourth fluid line (54) so that the operating fluid can be supplied to the motive side (63) for driving the steam jet ejector.

6. The turbine according to claim 5, wherein the fourth fluid line (54) is connected to the first fluid line (51) so that the operating fluid can be supplied to the motive side (63) of the steam jet ejector from the first fluid line (51).

7. The turbine according to claim 5, additionally comprising a servo valve (70) arranged in the fourth fluid line (54) for varying an amount of operating fluid that can be supplied to the motive side (63) of said pressure control device (60).

8. The turbine according to claim 7, wherein said pressure control device (60) is configured so that an amount of fluid removed from the second piston chamber (42) is approximately twice the amount of operating fluid supplied to the motive side (63) of said pressure control device (60).

9. The turbine according to claim 7 additionally comprising a sensor device (90), a signal output (82) and a second control device (80) having at least one signal input (81) connected to said sensor device (90) sensing at least one state parameter of the said turbine; said signal output (82) connected to said servo valve (70), and wherein said control device (80) constructed to control via said signal output (82) a degree of opening of said servo valve (70) depending on the at least one state parameter of the said turbine.

10. The turbine according to claim 9, wherein said sensor device (90) comprises a temperature sensor (91) for sensing the temperature of a thrust bearing of said rotor (20), and wherein said control device (80) is constructed to control the degree of opening of said servo valve (70) depending on a the temperature of a thrust bearing of said rotor (20).

11. The turbine according to claim 2, wherein said pressure control device (60) is constructed to vary the counterpressure by controlled suction of fluid from said second piston chamber (42).

12. The turbine according to claim 4, wherein said pressure control device (60) comprises a delivery side (62) connected by a third fluid line (53) to the flow path of the operating fluid at a further one of said turbine stage (30.2) of said turbine stages (30) situated downstream of said one of said turbine stage (30.1) in the flow path; and wherein said further turbine stage (30.2) has a second fluid pressure of operating fluid which is lower than the first fluid pressure.

13. The turbine according to claim 6, additionally comprising a servo valve (70) arranged in the fourth fluid line (54) for varying an amount of operating fluid that can be supplied to the motive side (63) of said pressure control device (60).

14. The turbine according to claim 8 additionally comprising a sensor device (90), a signal output (82) and a second control device (80) having at least one signal input (81) connected to said sensor device (90) sensing at least one state parameter of the said turbine; said signal output (82) connected to said servo valve (70), and wherein said control device (80) constructed to control via said signal output (82) a degree of opening of said servo valve (70) depending on the at least one state parameter of the said turbine.

* * * * *